United States Patent [19]

Zeeb

[11] Patent Number: 4,881,285

[45] Date of Patent: Nov. 21, 1989

[54] MOTORIZED CRADLE

[76] Inventor: Rhinhold J. Zeeb, Box 506, Menno, S. Dak. 57045

[21] Appl. No.: 266,844

[22] Filed: Nov. 3, 1988

[51] Int. Cl.[4] ..... A47D 9/02

[52] U.S. Cl. ..... 5/103; 5/109

[58] Field of Search ..... 5/108, 109, 101, 103, 5/105, 127; 297/281, 282; 128/33

[56] References Cited

U.S. PATENT DOCUMENTS

| | | | |
|---|---|---|---|
| 1,132,432 | 3/1915 | Brzozowski | 5/108 |
| 1,650,178 | 11/1927 | Atkinson | 5/103 |
| 1,973,753 | 9/1934 | Friesner | 5/103 |
| 2,076,675 | 4/1937 | Sharp | 5/103 |
| 2,380,355 | 7/1945 | Worley | 5/109 |
| 2,482,318 | 9/1949 | Carruth | 5/109 |
| 3,992,731 | 11/1976 | Carswell | 5/109 |
| 4,108,415 | 8/1978 | Hauray et al. | 297/281 |
| 4,258,446 | 3/1981 | McAllister et al. | 5/109 |
| 4,793,010 | 12/1988 | Gross et al. | 5/109 |

FOREIGN PATENT DOCUMENTS

| | | | |
|---|---|---|---|
| 137755 | 1/1920 | United Kingdom | 5/103 |

*Primary Examiner*—Alexander Grosz

[57] ABSTRACT

A power rocked cradle with timed control and supplemental music. The cradle is rocked by a motor through a crank and linkage.

3 Claims, 2 Drawing Sheets

MOTORIZED CRADLE

BACKGROUND AND SUMMARY OF THE INVENTION

This invention pertains to cradles for infants and more particular to a cradle mounted on a stationary base and adapted to be rocked by means of an electric motor operating through a crank and lever and controlled by a timer.

Cradles have been commonly used to soothe babies for many, many years. Some have theorized that the motion of the cradle simulates that of a fetus in the amniotic fluid and therefore is quieting to the infant. Most older cradles depended on arcuate rocker members rocking on the floor to provide the proper motion. More recently, some cradles have been mounted on bases and are swung and rocked on a quadrilateral linkage which simulates to some extent the motion of rocking on a rocker.

Previously, most cradles have been rocked gently by hand or, on occasion, by the foot of the attendant. Such an attendant might also sing a lullaby or some tune to the infant in the crib.

By my invention, the rocking of the cradle and the singing are accomplished without the need for constant attention, thus freeing the parent or other attendant to the infant for other tasks—at least temporarily. I do this by providing mechanical means for rocking the cradle and for providing music.

FIGURES

Figure 1:
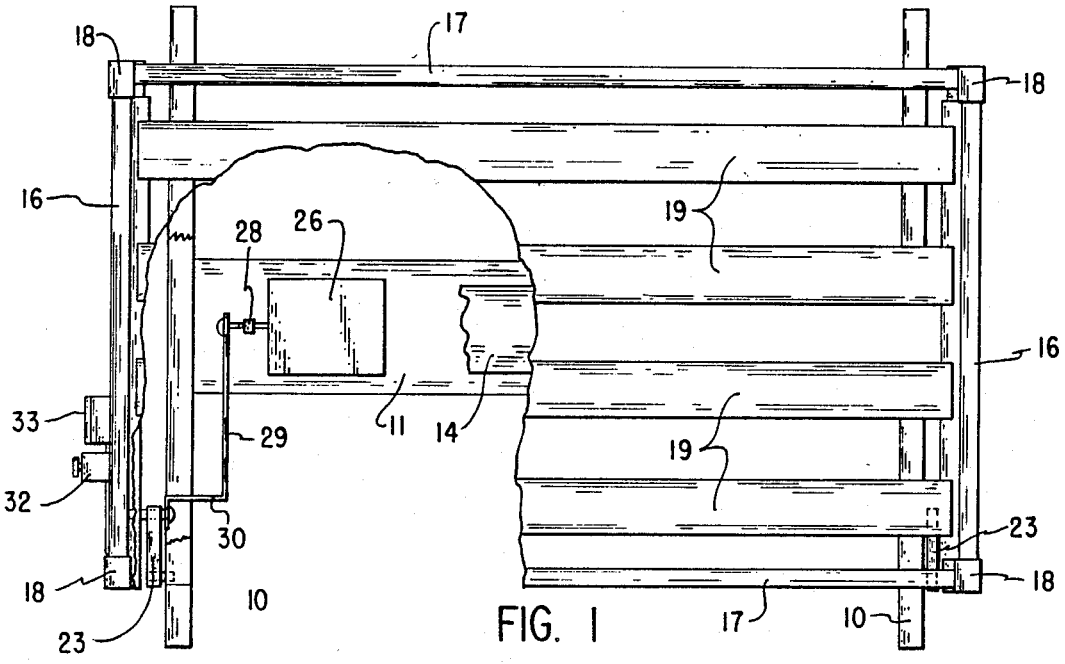
Figure 2:
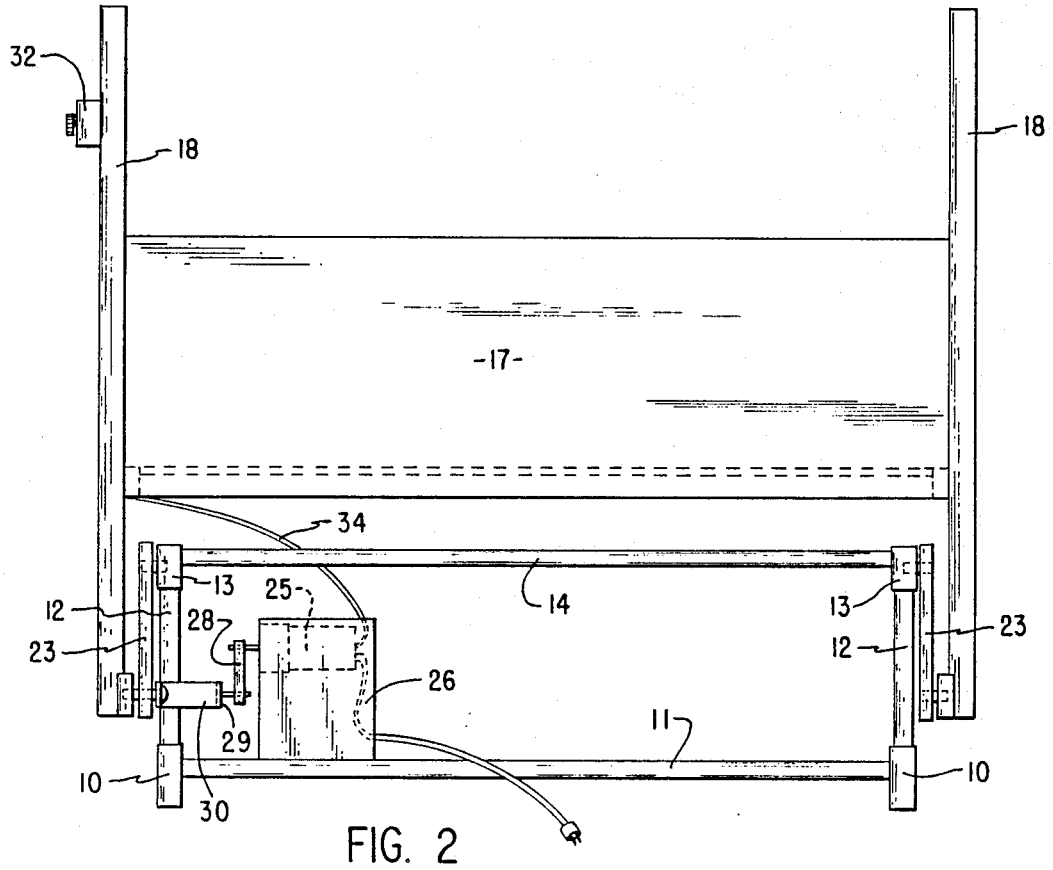
Figure 3:
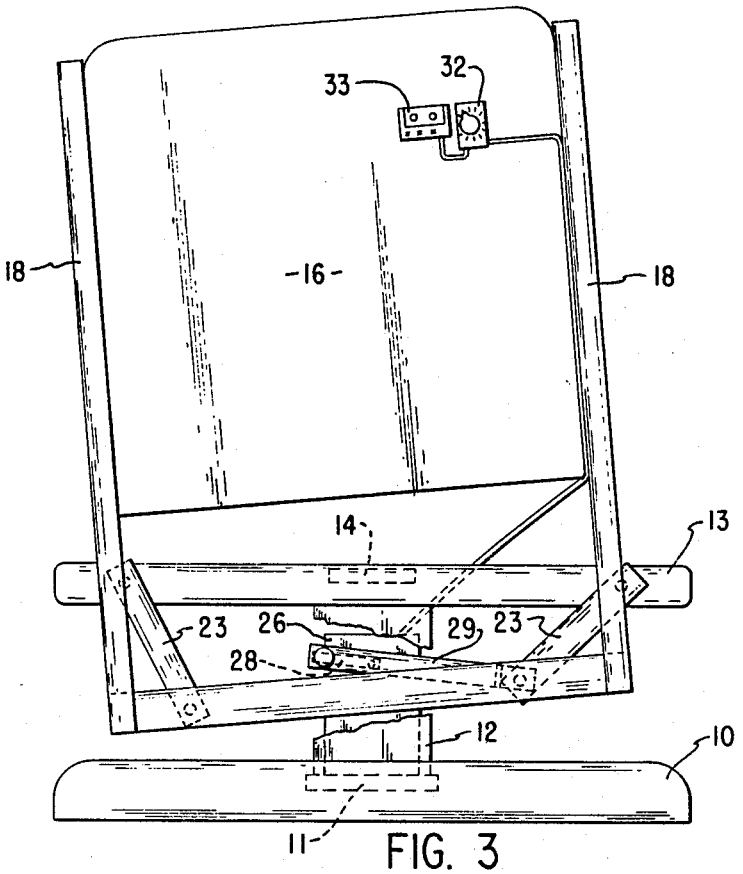
Figure 4:
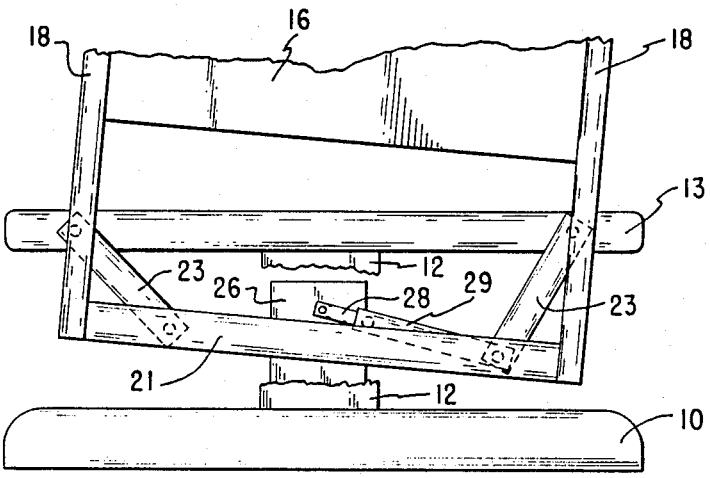

FIG. 1 is a top plan view of my cradle with part of the bottom of the cradle broken away to show the rocking motor, FIG. 2 is a side elevational view of the cradle, FIG. 3 is an end elevational view of the cradle rocked to one side, and FIG. 4 is a partial view similar to FIG. 3 with the cradle rocked to the opposite side from FIG. 3.

DESCRIPTION

Briefly, my invention comprises a cradle rocked by a power operated mechanism attached to the cradle and having a device attached to provide music to the cradle occupant.

More specifically, my cradle is mounted on a platform consisting of a pair of lateral feet 10 connected by a longitudinal brace member 11. From each foot 10 a vertical support member 12 rises to support the lateral hanger 13. The hangers 13 are also supported and steadied by a longitudinal brace 14.

The cradle bed is formed of two ends 16 joined by front and back sides 17. At the junctures of these sides with the ends 16 are four corner posts 18. Across the bottom are a series of slats 19 which provide support for a spring or mattress, the bedding, etc. (not shown). The posts 18 at both ends extend somewhat below the slats. At the the bottom of the posts 18 at each end of the cradle, these posts are joined by a transverse support member 21.

The bed is suspended from the base by links 23 pivotally joined between the hangers 13 and the support member 21 at each end of the cradle. In my preferred device, I use an electric motor 25 enclosed in a housing 26 to rock the bed back and forth on those links 23.

Spacing the pivot points of the links 23 closer together on the support member 21 then they are on the hanger 13 in a trapezoidal shape, causes the pattern of rocking to be not just a back and forth swing as would be the result of a parallelogram pattern, but instead, the rocking becomes a back and forth action plus a tilting motion somewhat similar to the rocking action on curved rockers.

The motion is transmitted from the motor 25 to the bed through a crank 28 mounted on the shaft of the motor and an arm 29 extending from the end of the crank 28 to the support member 21. For convenience the pivoted fastening between this arm 29 and the bed and its support member 21 may be at the same point as that of one of the links 23 as I also propose to use an arm 29 having an L-shape with a fairly long leg 30 on the shape. By using this form and making the arm of a metal or some resilient material, I can provide a device that has a bit of flexibility in its movement so that minor interference with the motion will not immediately stall the motor 25 nor fracture the arm 29, but will be absorbed by the resilience of the arm.

The motor 25 is controlled through a timer 32 on one end 16 of the bed where the timer will be readily accessible. A small audio-tape player 33 may also be provided here and also be controlled by the timer 32. The wires 34 to the controls may be in the open as shown or may be more hidden so long as a loop is provided to absorb the motion of the bed part relative to the base.

Thus, by setting the timer and using the rocking mechanism, an infant in the cradle would be gently rocked and lulled to sleep either with or without the use of the tape player. If the player is used, I envision that a parent's voice might well be used on the tape so that the infant would be familiar with the voice he or she was hearing.

I claim as my invention:

1. A cradle comprising a base member and a bed member, linkage between said base member and said bed member whereby said bed member is supported from said base member, said linkage being pivotally attached to said base member and said bed member to form a trapezoidal figure having a longer part at the top of said trapezoid and a shorter part at the bottom of said trapezoid, and power means including a motor mounted on said base member, said motor having a shaft, crank means mounted on said shaft, and link means connected between said crank means and said bed member whereby motion of said shaft causes a rocking of said bed member, said link means being L-shaped in plan form having one long leg pivotally connected to said crank means and one short leg at right angle to said long leg, said short leg being of a resilient material to provide a resilient connection between said bed member and said crank means.

2. The cradle of claim 1 in which timing means is connected to said power means to control the length of time said power means is operated.

3. The cradle of claim 2 in which music reproduction means is also mounted on said bed member and connected to said timing means so that said reproduction means operates during the same time period as said power means.

* * * * *